US010651612B2

(12) United States Patent
Cheng et al.

(10) Patent No.: US 10,651,612 B2
(45) Date of Patent: May 12, 2020

(54) ELECTRICAL CONNECTOR WITH LOWER PROFILE

(71) Applicant: FOXCONN INTERCONNECT TECHNOLOGY LIMITED, Grand Cayman (KY)

(72) Inventors: Chih-Pi Cheng, New Taipei (TW); Wen He, Kunshan (CN); Quan Wang, Kunshan (CN); Miao-Hui Gong, Kunshan (CN); Chao-Chieh Chen, New Taipei (TW)

(73) Assignee: FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 9 days.

(21) Appl. No.: 15/865,197

(22) Filed: Jan. 8, 2018

(65) Prior Publication Data

US 2018/0198246 A1 Jul. 12, 2018

(30) Foreign Application Priority Data

Jan. 6, 2017 (CN) ..... 2017 1 0009413

(51) Int. Cl.

| | |
|---|---|
| ***H01R 13/648*** | (2006.01) |
| ***H01R 24/60*** | (2011.01) |
| ***H01R 12/72*** | (2011.01) |
| *H01R 107/00* | (2006.01) |
| *H01R 13/6587* | (2011.01) |
| *H01R 13/6581* | (2011.01) |

(Continued)

(52) U.S. Cl.

CPC ..... *H01R 24/60* (2013.01); *H01R 12/727* (2013.01); *H01R 13/648* (2013.01); *H01R 13/6466* (2013.01); *H01R 13/6581* (2013.01); *H01R 13/6587* (2013.01); *H01R 13/6594* (2013.01); *H01R 24/62* (2013.01); *H01R 2107/00* (2013.01)

(58) Field of Classification Search

CPC ..... H01R 13/648; H01R 13/6581; H01R 13/6587; H01R 13/6594; H01R 23/6873; H01R 23/7073; H01R 23/02; H01R 24/60; H01R 24/62; H01R 13/6466

USPC ..... 439/660, 676, 607.01, 607.4

See application file for complete search history.

(56) References Cited

U.S. PATENT DOCUMENTS

| | | | | |
|---|---|---|---|---|
| 9,627,817 | B2 * | 4/2017 | Chang | H01R 13/6594 |
| 10,218,126 | B2 * | 2/2019 | Kurosawa | H01R 24/60 |

(Continued)

*Primary Examiner* — Abdullah A Riyami
*Assistant Examiner* — Justin M Kratt
(74) *Attorney, Agent, or Firm* — Wei Te Chung; Ming Chieh Chang

(57) ABSTRACT

An electrical connector mounted on a PCB includes: an housing comprising a base, a mating tongue and a mounting portion, each surface of the mating tongue defining twelve terminal positions (P1) through (P12); two rows of terminals, each terminal including a mating portion, a leg portion and a middle portion connecting with the mating portion and the leg portion, each leg portion defining a soldering pad. Each row of terminals include grounding terminals in terminal positions (P1, P12) power terminals in terminal positions (P4, P9), and there are no terminals set in terminal positions (P2, P3, P10, P11). The soldering pads of the two rows of terminals are arranged in one row and at least two grounding terminals or two power terminals aligned with each other in a vertical direction are located side by side so as to share a same pad defined on the PCB.

12 Claims, 16 Drawing Sheets

(51) Int. Cl.

| | |
|---|---|
| *H01R 24/62* | (2011.01) |
| *H01R 13/6466* | (2011.01) |
| *H01R 13/6594* | (2011.01) |

(56) References Cited

U.S. PATENT DOCUMENTS

| | | | | |
|---|---|---|---|---|
| 2016/0197442 | A1* | 7/2016 | Lin | H01R 13/6585<br>439/607.05 |
| 2018/0097310 | A1* | 4/2018 | Ju | H01R 13/04 |

* cited by examiner

ELECTRICAL CONNECTOR WITH LOWER PROFILE

BACKGROUND OF THE INVENTION

1. Field of the Invention

The present invention relates to an electrical connector mounted on a printed circuit (PCB).

2. Description of Related Art

USB-IF has issued a new receptacle which can be inserted by a plug in two different orientations on Oct. 11, 2014 and named USB Type-C transmitting USB 2.0 and USB 3.1 signals. USB 2.0 Type-C connectors and cable assembles are widely used in mobile device like smartphones and tablet PCs. As mobile devices become be more and more small, the receptacle is still hoped to have a lower profile even though the USB Type-C has a smaller dimension.

In view of the above, an improved electrical connector is desired to overcome the problems mentioned above.

SUMMARY OF THE INVENTION

Accordingly, an object of the present disclosure is to provide a an electrical connector with a lower profile.

According to one aspect of the present disclosure, an electrical connector mounted on a printed circuit (PCB), comprises: an insulating housing comprising a base, a mating tongue extending forward from the base and a mounting portion extending rearward from the base, the mating tongue defining two opposite mating surfaces and each mating surface defining twelve terminal positions P1 through P12; two rows of terminals, each terminal comprising a mating portion exposed upon the mating tongue, a leg portion extending out of the mounting portion and a middle portion connecting with the mating portion and the leg portion, each leg portion defining a soldering pad. Each row of terminals comprises grounding terminals in terminal positions P1, P12, power terminals in terminal positions P4, P9, and there are no terminals set in terminal positions P2, P3, P10, P11. The soldering pads of the two rows of terminals are arranged in one row and at least two grounding terminals or at least two power terminals aligned with each other in a vertical direction are located side by side so as to share a same pad defined on the PCB.

Other objects, advantages and novel features of the disclosure will become more apparent from the following detailed description when taken in conjunction with the accompanying drawings.

DETAILED DESCRIPTION OF THE INVENTION

Figure 1:
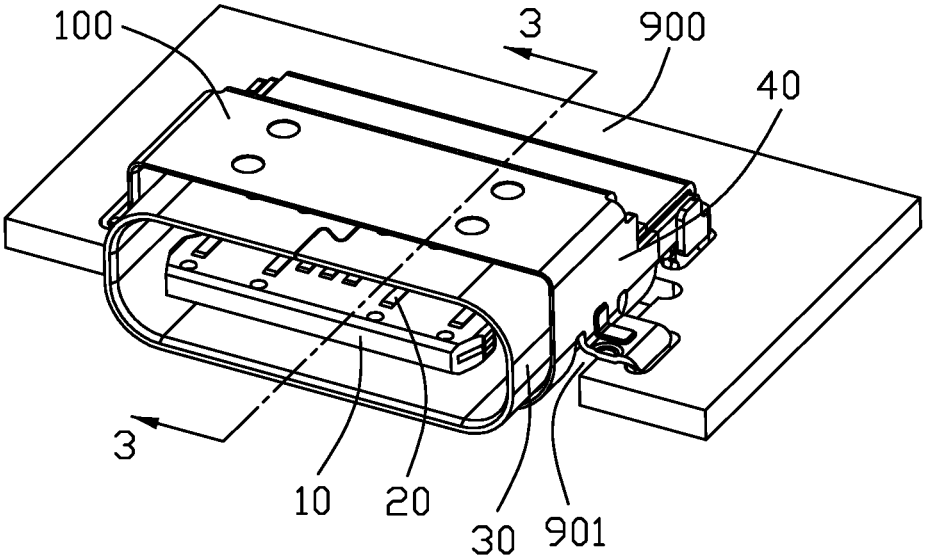
FIG. 1 is a front perspective view of an electrical connector mounted on a PCB in accordance with a preferred embodiment of the present invention.

Reference will now be made to the drawings to describe a preferred embodiment of the present disclosure in detail.

FIG. 1 through FIG. 10 illustrating a first embodiment of an electrical connector 100 of the present invention, the electrical connector 100 in a form of a sink board receptacle, is mounted in a notch 901 of a printed circuit board 900 and adapted for mating with a plug (not shown) and thus establish an electrical connection between the receptacle and the plug. The electrical connector 100 includes an insulating housing 10, terminals 20, and a shell including a metallic inner shell 30 and a metallic outer shell 40.

Figure 2:
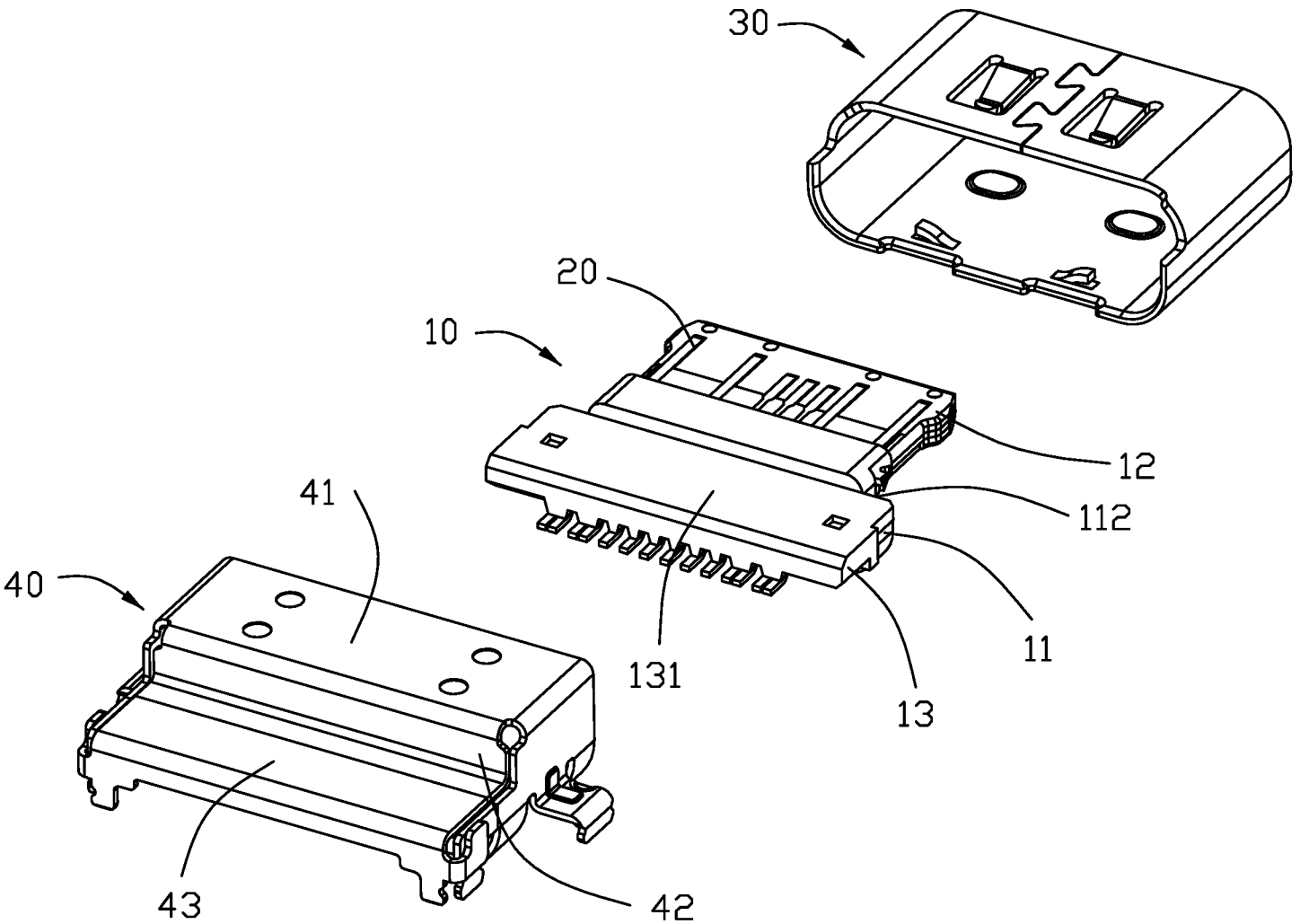
FIG. 2 is a rear exploded perspective view of the electrical connector in FIG. 1.
Figure 3:
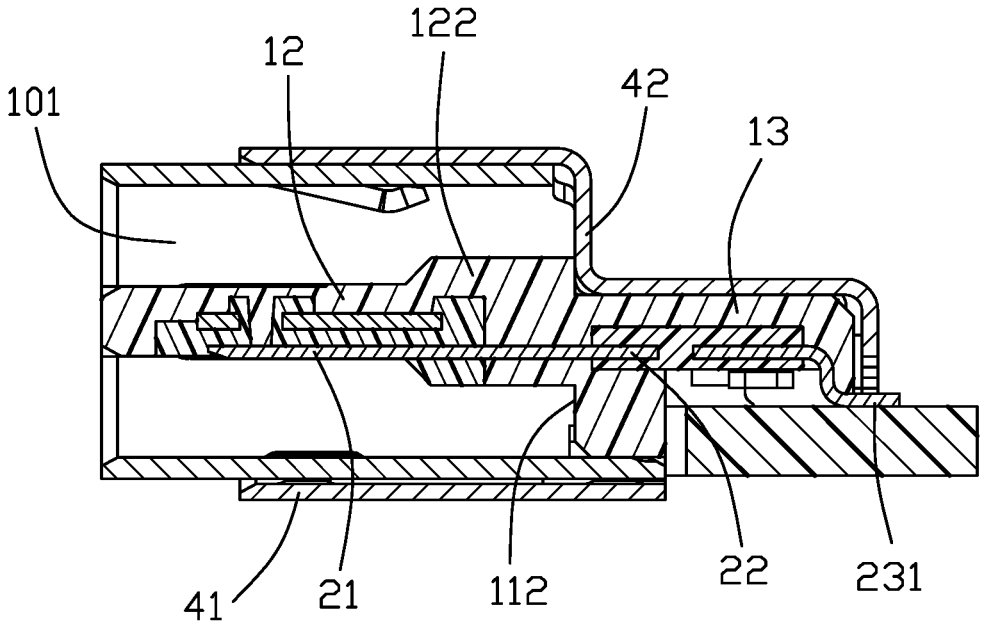
FIG. 3 is a cross sectional view taken along lines 3-3 in FIG. 1.
Figure 4:
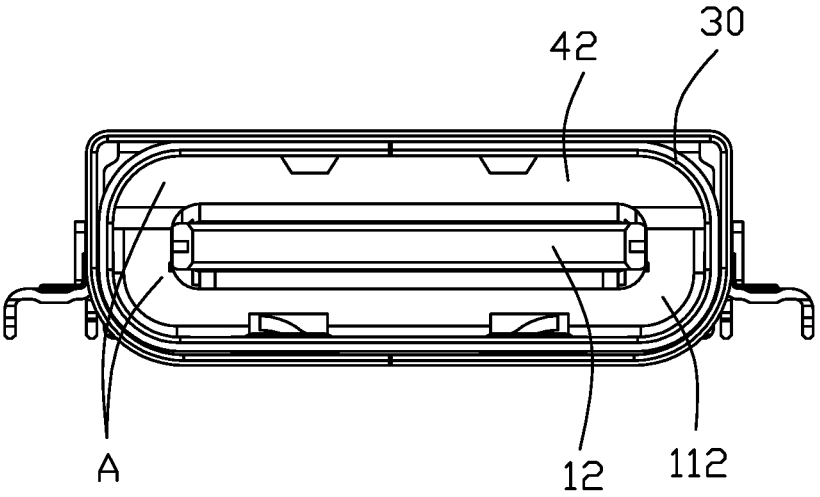
FIG. 4 is a front planar view of the electrical connector.

Referring to FIG. 2 in combination with FIGS. 3-4, the housing 10 includes a base or retaining portion 11 defining a front face 112, a mating tongue 12 extending from the front face 112 of the retaining portion and a mounting portion 13 extending rearwards from a rear face of the retaining portion 11. The mounting portion 13 defines an upper face 131 which is flush with the corresponding upper face of the retaining portion 11. The inner shell 30 is fitly retained around the retaining portion 11 and surrounding the mating tongue 12, thereby defining a mating cavity 101 among the inner shell 30 and the mating tongue 12 as best shown in FIGS. 3-4. The outer shell 40 includes a front portion 41 surrounding the inner shell 30 and a vertical or middle portion 42 perpendicularly bending from a rear edge of the front portion 41. The middle portion 42 abuts with the mating cavity 101, which is flush with the front face 112 of the retaining portion 11 and commonly defined as a stop face A (labeled in FIG. 4) to limit an insertion of the plug into the mating cavity 101 of the electrical connector 100. The outer shell 40 further includes a rear portion 43 bending rearward from a lower edge of the middle portion 42, which covers on the upper face 131 of the mounting portion 13. The retaining portion 11 is basically used to engage with the inner shell 30 and retain the inner shell 30, and the mounting portion 13 is used to be supported on the printed circuit board 900. The upper face 131 of the mounting portion 13 is lower than the top face (not labeled) of the whole electrical connector 100. In this preferred embodiment, the mating tongue 12 further defines a thickened step portion 122, which is used to support spring pads in the plug if the plug has. The upper face of the step portion 122 is higher than the upper face of the retaining portion 11 and the upper mating surface of the front region of the mating tongue 12. Understandingly, as part of the housing 10 is cut away, the length of the whole electrical connector 100 along a front and rear direction reduces from 8.3 mm to 7.3 mm. Therefore, the shortened electrical connectors 100 are suitable to be used in mobile devices. The length of the mounting portion 13 in the front and rear direction becomes larger and the length of the mating cavity 103 kept a predetermined size, that means, the engagement of the receptacle and the plug is kept as usual and the retaining force of the receptacle on the PCB is strengthen even though the whole length is shortened.

Figure 5:
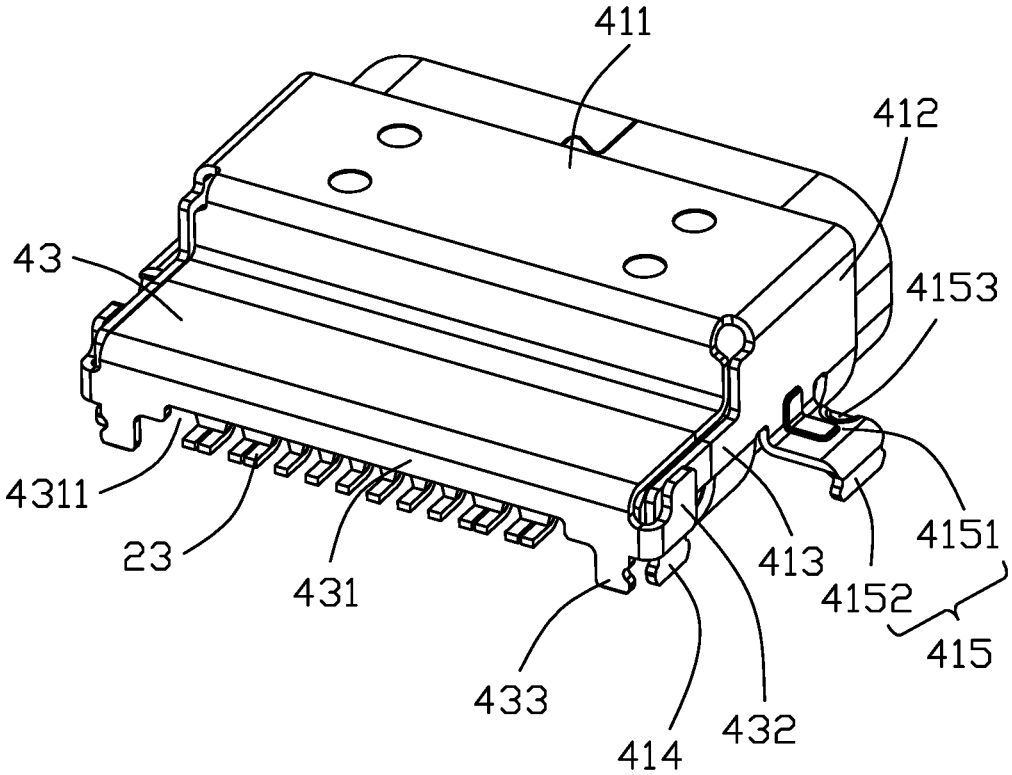
FIG. 5 is a rear perspective view of the electrical connector.
Figure 6:
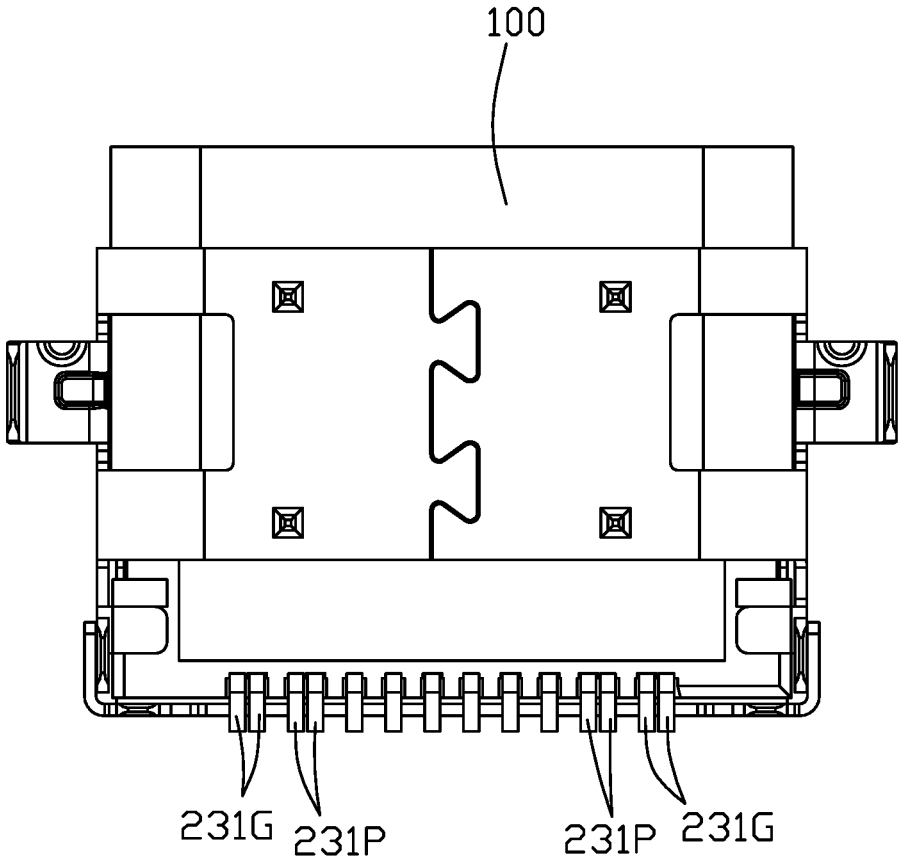
FIG. 6 is a bottom planar view of the electrical connector.
Figure 7:
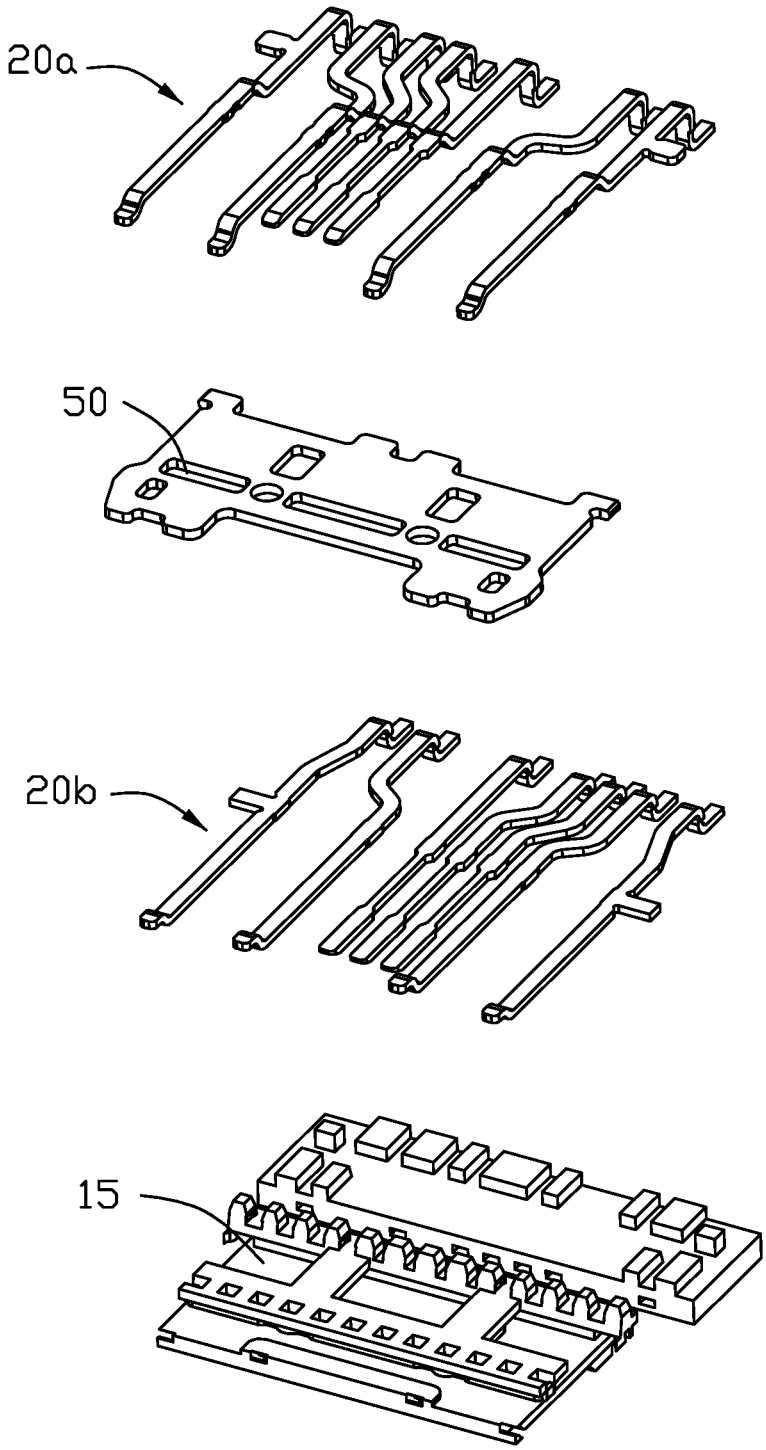
FIG. 7 is a top exploded perspective view of a first insulator, a metallic shell and terminals of the electrical connector.

Referring to FIG. 1 and FIG. 5, the front portion 41 of the outer shell 40 includes a top wall 411, two sidewalls 412 with two mounting legs 415. Each mounting leg 415 includes a horizontal portion 4151 confronting on the top face of the PCB 900 and a vertical portion 4152 inserting into a hole as shown in FIG. 1 of the PCB. The horizontal portion 4151 defines a downward dimple 4153. The sidewalls 412 further define extending arms 413 extending rearwards. The rear portion of the outer shell 40 defines a rear wall 431 bending downward, and a tab 432 bends forwards from lateral side of the rear wall 431 and is welded with the rear portion of the extending arm 413. The rear wall 431 further defines a large notch 4311 to expose the leg portions 23 of the terminals 20.

The extending arm 413 defines a mounting leg 414 under the tab 432 and the rear wall 431 defines two soldering legs 433 near to the tab 432. All the soldering legs 414, 433 are inserted into and welded with corresponding holes defined on the PCB 900 as best shown in FIG. 1. The inner shell 30 is in a capsular shape, the front portion 41 of the outer shell is in a rectangular shape and the lower wall of the front portion is fitly matched with the lower wall of the inner shell 30.

Referring to FIG. 7 through FIG. 10, the terminals 20 are arranged in two rows. A first insulator 15 is insert-molded with the low terminals 20*b* and a shielding plate 50. The upper terminals 20*a* are disposed on the first insulator 15 and then a second insulator 16 is insert-molded on the first insulator 15 and the upper terminals 20*a*, thereby the insulating housing 10 is completely formed.

Figure 8:
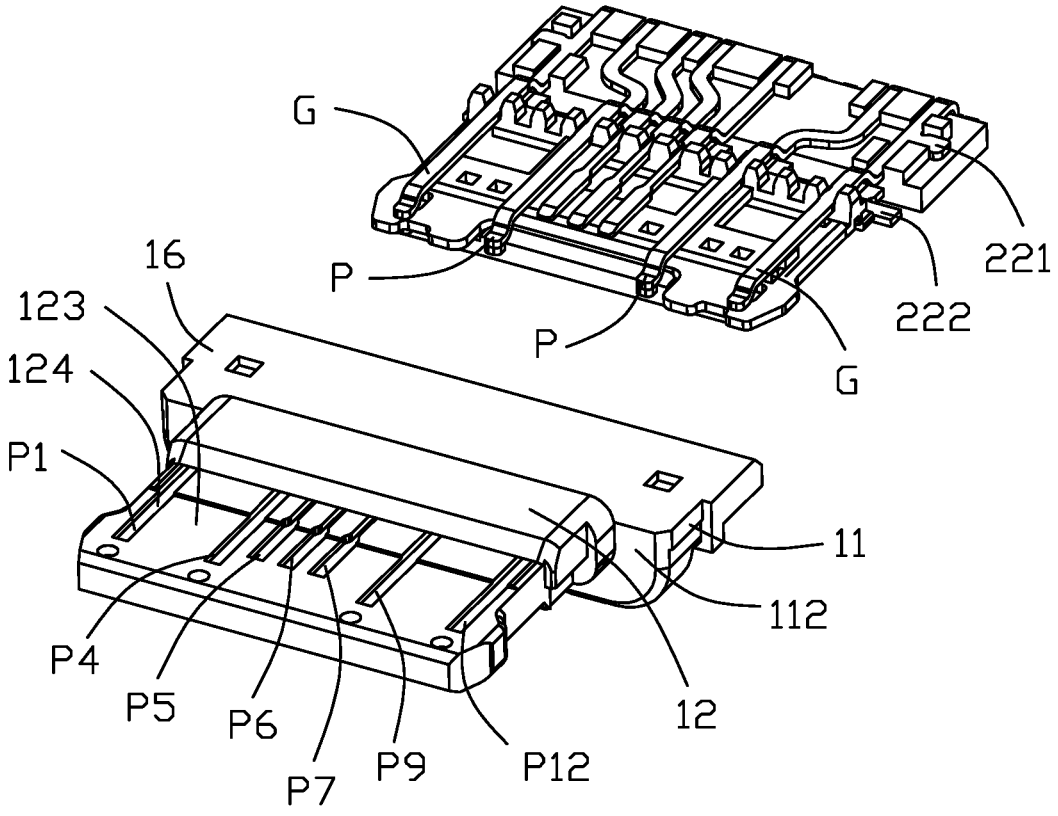
FIG. 8 is a top exploded perspective view of the second insulator and the first insulator assembled with the metallic plate and the terminals.
Figure 9:
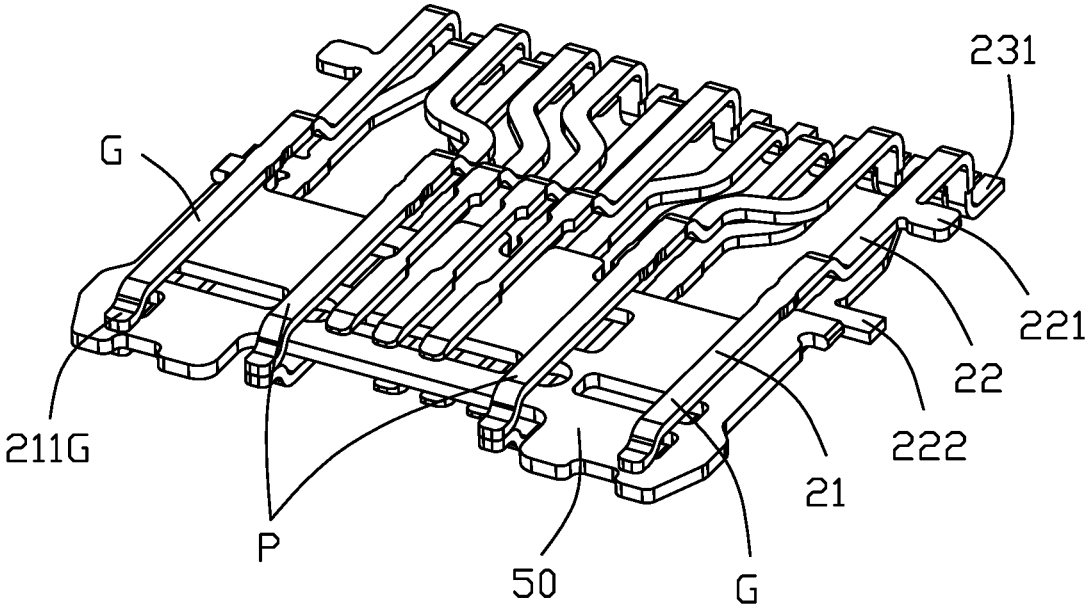
FIG. 9 is a perspective view of the terminals and the metallic plate.
Figure 10:
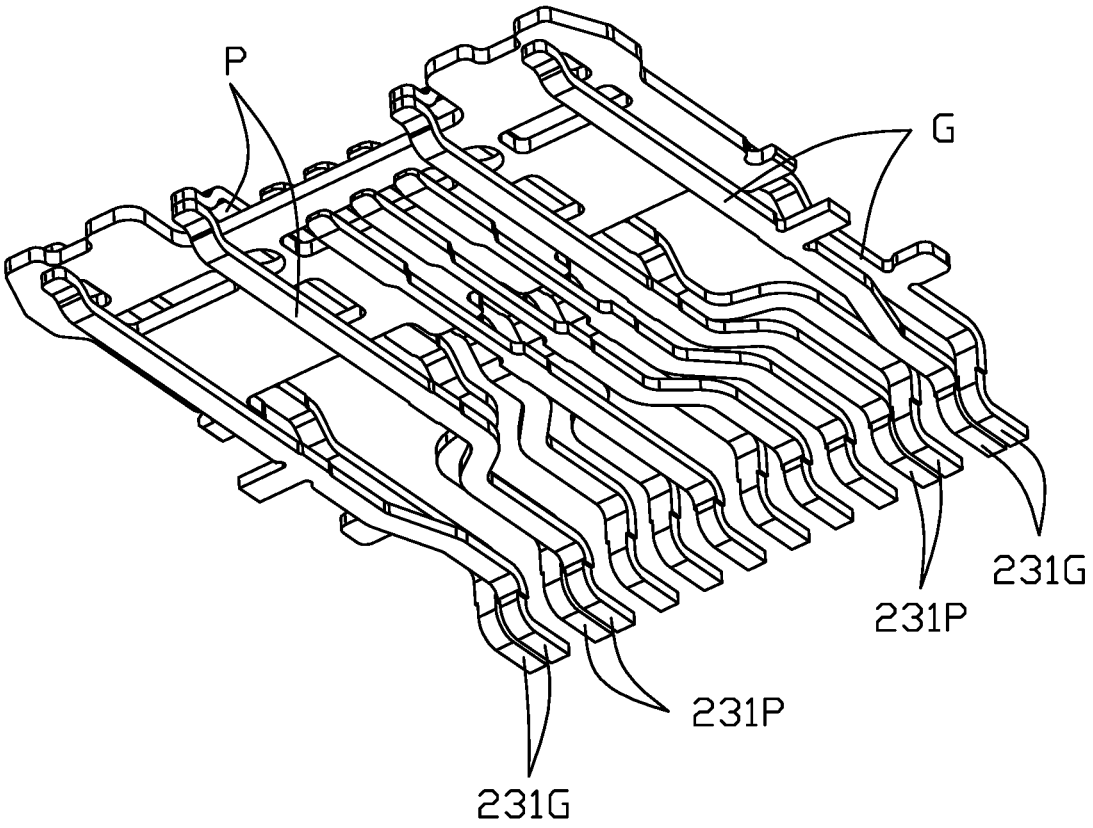
FIG. 10 is a bottom perspective view of FIG. 9.
Figure 11:
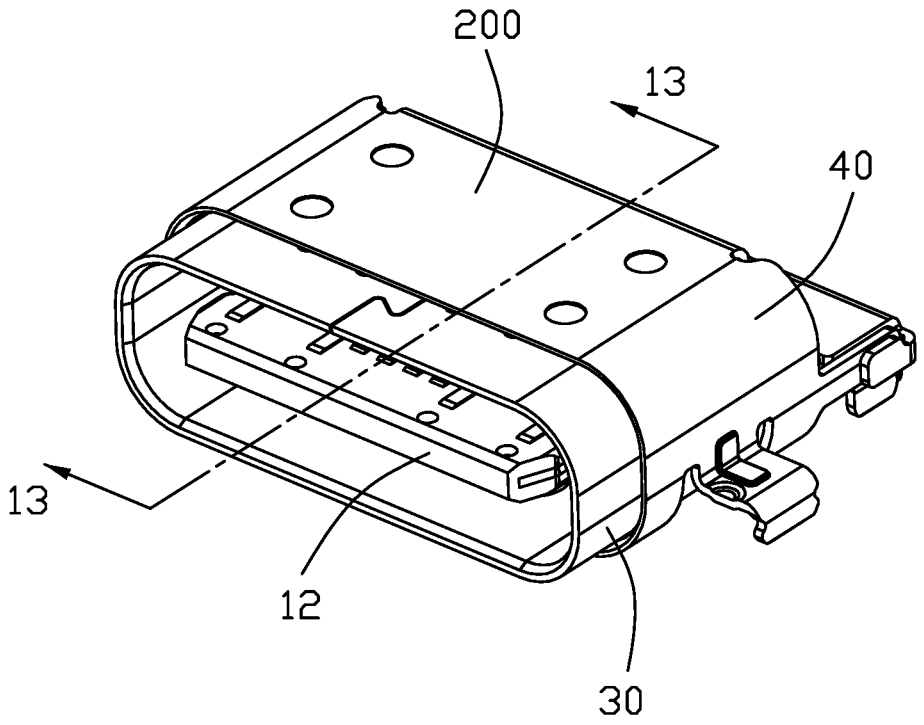
FIG. 11 is a top perspective view of an electrical connector of a second embodiment.

The mating tongue 12 defines two opposite mating surfaces 123, and each mating surface defines twelve terminal positions P1 through P12. which are compatible to the USB Type-C definition. In this embodiment as best shown in FIG. 8, the housing 10 defines terminal passages 124 in a couple of the terminal positions where the terminals are required, to receive terminals 20 and there are no terminal passages if there are no terminals required. As shown in FIG. 8, only the terminal positions P1, P4~P7, P9, P12 on the upper mating surface are shown and labeled, that is, these terminal positions are equipped with terminal passages 12 and disposed with terminals. Understandingly, terminal positions P2, P3, P8, P10, P11 are without any terminal passages and terminals on the upper surface of the mating tongue are not labeled. The terminal positions P2, P3, P5, P10, P11 on the lower surface of the mating tongue are also not labeled. In combination with FIG. 3, each terminal 20 comprises mating portion 21, leg portion 23 extending out of the mounting portion 13 and a middle portion 22 connecting with the mating portion 21 and the leg portion 23, each leg portion 23 defines a soldering pad 231. In this embodiment, the connector 100 includes grounding terminals G in the terminal positions P1, P12, power terminals in the terminal positions P4, P9, signal terminals transmitting data signal and detecting signal in the terminal positions P5~P7. As best shown in FIGS. 9 and 10, the mating portions 21 of the upper and lower terminals are aligned with each other in the upper and lower direction and the middle portions 22 are shifting. The soldering pads 231 of the upper row and the soldering pads of the lower row are alternatively arranged one by one in one row. The corresponding two soldering pads 231 of the grounding terminals G in the two rows are located side by side and welded with a same grounding pad defined on the printed circuit board 900, and the corresponding two soldering pads of the power terminals P in the two rows are also located side by side and welded with a same power pad defined on the printed circuit board 900. In other embodiment, there might be terminals disposed in terminal positions P8, P5.

Referring to FIGS. 9 and 10, the metallic plate 50 is located between the mating portions 21 of the terminals and extending rearward in front of the step portion 122 as best shown in FIG. 3. The front ends 211G of the grounding terminals G touch the metallic plate 51 to establish a grounding path. The grounding terminals G of the upper row 20*a* further define an upper tab 221 extending outward from the middle portion 22 and the grounding terminals of the lower row 20*b* further define a lower tab 222 extending outward from the middle portion 22. As shown in FIG. 8, the upper tab 221 is located at the mounting portion 13 and the lower tab 222 is located at the retaining portion 11. The rear edge of the metallic plate 50 is located in front of the lower tab 222. The metallic plate 50 is suitable for the connector of a lower profile.

Figure 12:
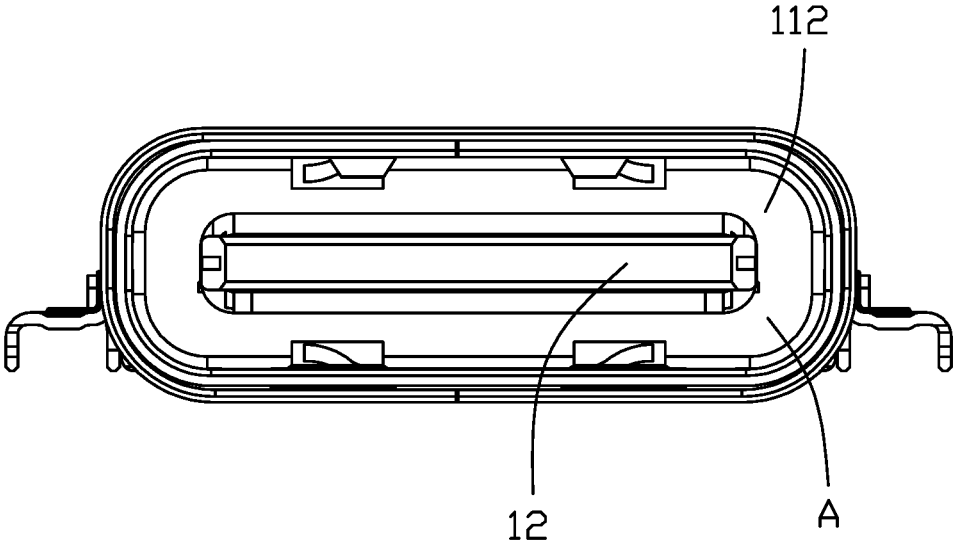
FIG. 12 is a front planar view of FIG. 11.

FIGS. 11 through 16 illustrates an electrical connector 200 of a second embodiment which is similar to the connector 100 of the first embodiment. The outer shell 40 has a front portion matching with the inner shell 30, and thus the front portion fitly surrounds the inner shell 30. Alternatively, the inner shell and the outer shell can be formed as an integrality, and be called as a shielding shell retained around the retaining portion 11 and defining the mating cavity 101. Referring to FIG. 12, the front face 112 of the retaining portion 11 is used to limit the insertion of the plug, i.e., the stop face A.

Figure 13:
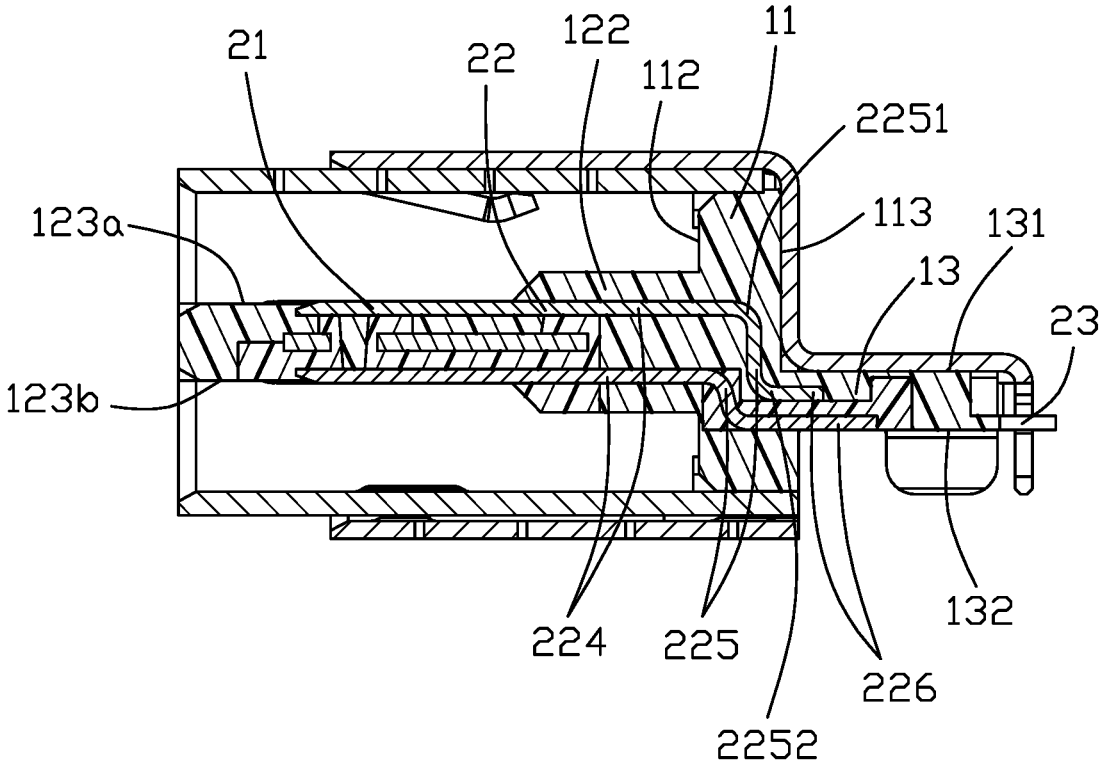
FIG. 13 is a cross sectional view taken along lines 13-13 in FIG. 11.
Figure 14:
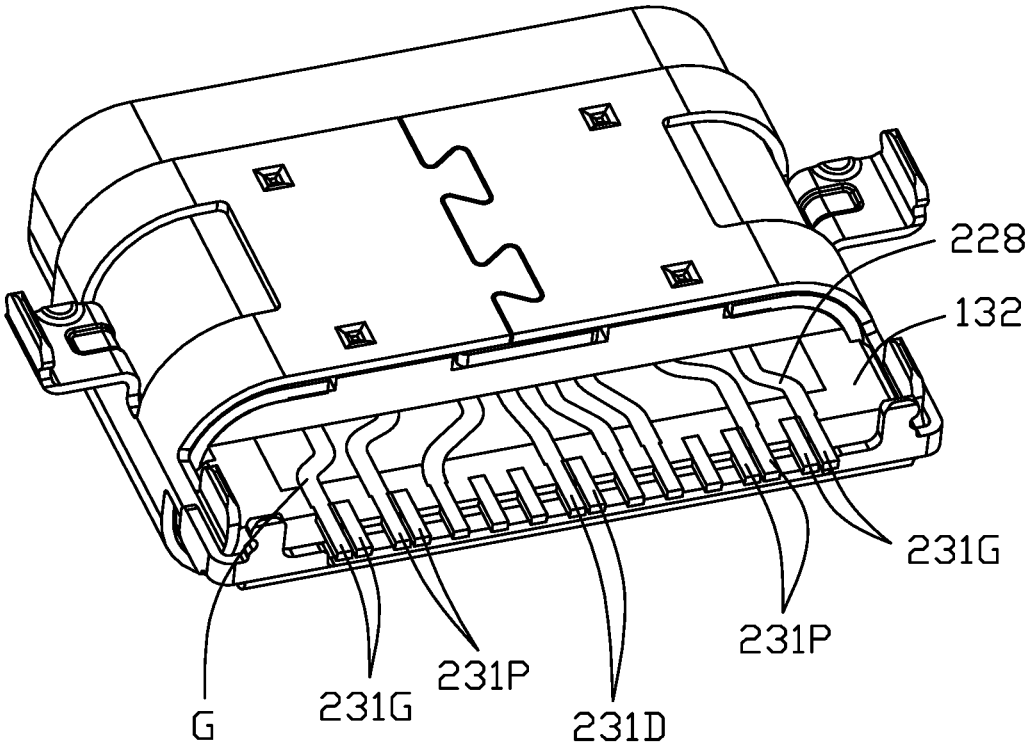
FIG. 14 is a bottom perspective view of the electrical connector.
Figure 15:
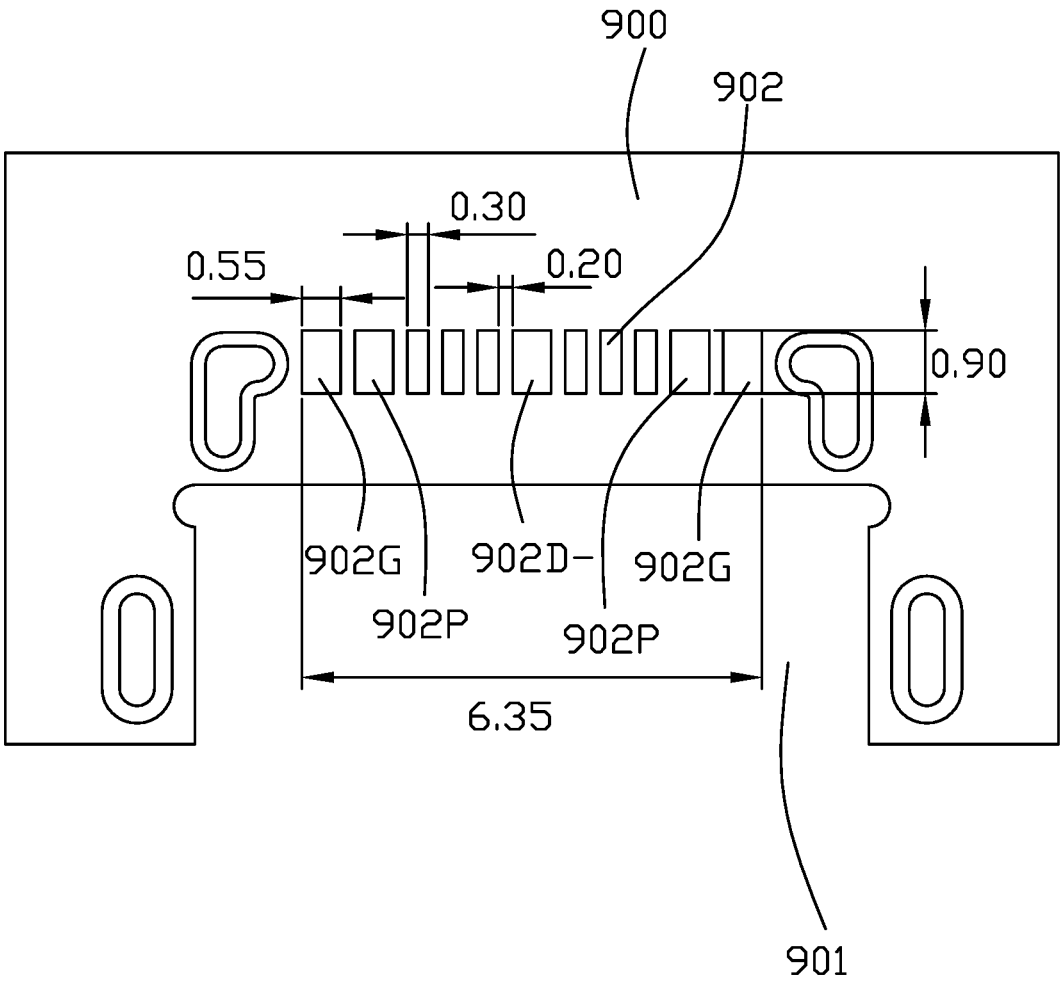
FIG. 15 is a perspective view of the PCB.

Referring to FIGS. 13 and 15, the electrical connector 200 is mounted in the notch 901 of the PCB 900 in a right angle pattern. The electrical connector 200 includes an insulating housing 10 with a front mating tongue 12, a middle retaining portion 11 or base and a rear mounting portion 13, and two rows of terminals 20. The mating tongue defines an upper mating surface 123*a* and a lower upper mating surface 123*b*, the retaining portion 11 defines a front face 112 and a rear face 113, the mounting portion 13 defines an upper face 131 and a lower face 132. The mating tongue 12 extends forwards from the front face 112 of the retaining portion 11, the mating tongue defines a thickened step portion 122 at a root thereof to the retaining portion 11. The mounting portion 13 extends rearwards from the rear face 113 of the retaining portion. Each terminal 20 includes a mating portion 21 exposed upon the mating surface, a leg portion 23 extending from the retaining portion 11 and a middle portion 22. The grounding pads 231G of corresponding grounding terminals of the upper and lower row of the terminals are disposed side by side and to be soldered with a same widened grounding pad 902G on the printed circuit board 900. The power pads 231P of corresponding power terminals of the upper and lower row of the terminals are disposed side by side and to be soldered with a same widened power pad 902P on the printed circuit board 900. The power pads 902P and the grounding pads 902G have a width of 0.55 mm, and other pads have a width of 0.3 mm. The pitch of every two adjacent pads is 0.2 mm. All the pads have a length of 0.9 mm. In the second embodiment, in the terminal position P5 of the upper mating surface and the terminal position P8 of the lower mating surface, there are two detecting terminals. The terminals in terminal positions P6, P7 in the upper surface and the terminals in the terminal positions P7, P9 in the lower surface of the mating tongue are signal terminals transmitting USB 2.0 signal, i.e., USB 2.0 terminals, the soldering pads 231D of the negative terminals of the USB 2.0 terminals are located side by side and share a same widened negative pad 902D−.

Figure 16:
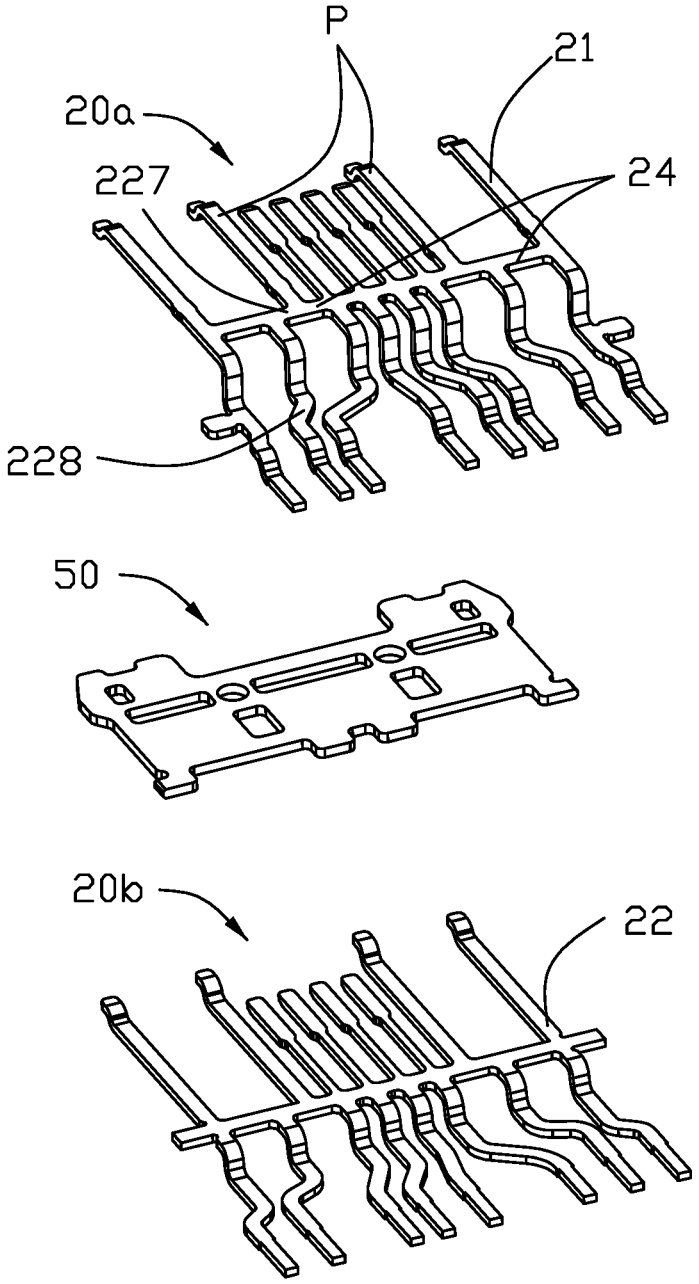
FIG. 16 is an exploded perspective view of terminals with carriers and a metallic plate.

Referring to FIG. 13 and FIG. 16, the mounting portion 13 can be as low as possibly to decease the height of the connector on the PCB. The middle portions 22 of the terminals bend in front of the mounting portion 13.

Each middle portion 22 includes an upper horizontal section 224, a middle connecting section 225 and a lower horizontal section 226, the upper horizontal section 224 extends from the mating portion 21, the lower horizontal section 226 extend with the leg portion, the middle retaining section 225 is located in the retaining portion 11 of the insulating housing. In preferred embodiment, the middle section 225 is in a vertical shape. The middle section 225 defines an upper bending point 2251 and a lower bending point 2252, the two upper bending points 2251 are located in front of the rear face 113 of the retaining portion 11 and the two lower bending points 2252 are located in front of the rear face 113 of the retaining portion. The upper bending points 2251 of the lower terminals are located in front of the upper bending points of the upper terminals. The lower bending points 2252 of the lower terminals are located in front of the lower bending points of the upper terminals. The lower horizontal section 226 of the lower row extends out of the rear portion 223 and is exposed upon the lower face 132 of the mounting portion 13, so as to decrease the height of the mounting portion on the PCB. FIG. 16 illustrating the two rows of terminals with carriers 24, each of the middle portions 22 of the power terminals P defines a front shifting section 227 and a rear shift section 228, the front shifting sections are located in the step portion 22 or the retaining portion 11. Other terminals laterally bend one time. A height of the mounting portion decreases from 1.2 mm to 0.7 mm.

While preferred embodiments in accordance with the present disclosure have been shown and described, equivalent modifications and changes known to persons skilled in the art according to the spirit of the present disclosure are considered within the scope of the present disclosure as defined in the appended claims.

What is claimed is:

1. An electrical connector mounted on a printed circuit (PCB), comprising:

an insulating housing comprising a base, a mating tongue extending forward from the base and a mounting portion extending rearward from the base, the mating tongue defining two opposite mating surfaces and each mating surface defining twelve terminal positions P1 through P12;

two rows of terminals, each terminal comprising a mating portion exposed upon the mating tongue, a leg portion extending out of the mounting portion and a middle portion connecting with the mating portion and the leg portion, each leg portion defining a soldering pad;

each row of terminals comprising grounding terminals in terminal positions P1, P12, power terminals in terminal positions P4, P9, and there are no terminals set in terminal positions P2, P3, P10, P11;

wherein the soldering pads of the two rows of terminals are arranged in one row and at least two grounding terminals or at least two power terminals aligned with each other in a vertical direction are located side by side so as to share a same pad defined on the PCB.

2. The electrical connector as claimed in claim 1, wherein each row of terminals comprises a pair of USB 2.0 signal terminals consisting of a positive terminal and a negative terminal, the soldering pads of the two negative terminals of USB 2.0 signal terminals are located side by side so as to share a same signal pad defined on the PCB.

3. The electrical connector as claimed in claim 1, wherein the PCB defines a widened power pad to be welded with said two side by side soldering pads of power terminals, and a widened grounding pad to be welded with said two side by side soldering pads of the grounding terminals.

4. The electrical connector as claimed in claim 3, wherein the grounding pads and the power pads each have a width of 0.55 mm.

5. The electrical connector as claimed in claim 4, wherein every adjacent two soldering pads define therebetween a pitch of 0.2 mm.

6. The electrical connector as claimed in claim 5, wherein each pad on the PCB has a length of 0.9 mm.

7. An electrical connector mounted on a printed circuit (PCB), comprising:

an insulating housing comprising a base, a mating tongue extending forward from the base and a mounting portion extending rearward from the base, the mating tongue defining two opposite mating surfaces, the base defining a front face and a rear face;

two rows of terminals, each terminal comprising a mating portion exposed upon the mating tongue, a leg portion extending out of the mounting portion and a middle portion connecting with the mating portion and the leg portion;

wherein each middle portion of the terminals comprises an upper horizontal section, a lower horizontal section and a connecting section connecting with the upper and lower horizontal section, the connecting section defines an upper bending point and a lower bending point, all the upper bending points and lower bending points are located in front of the rear face of the base;

wherein all the upper bending points and lower bending points are located behind the front face of the base;

wherein the upper bending points of the lower row are located in front of those of the upper row, and the lower bending points of the lower row are located in front of those of the upper row.

8. The electrical connector as claimed in claim 7, further comprising a metallic plate located between the mating portions of the two rows of the terminals, wherein a rear edge of the metallic plate is disposed in front of the front face of the base.

9. An electrical connector comprising:

an insulating housing comprising a base, a mating tongue extending forward from the base and a mounting portion extending rearward from the base, the mating tongue defining two opposite mating surfaces, the base defining a front face and a rear face;

two rows of terminals disposed in the insulating housing;

an inner shell retained around the base and surrounding the mating tongue thereby defining a mating cavity among the mating tongue and the inner shell;

an outer shell comprising a front portion retained on the inner shell, a rear portion covering the mounting portion and a middle portion connecting with the front portion and the rear portion;

wherein the middle portion of the outer shell and the front face of the base is facing the mating cavity and commonly constructed as a stop face to limit an insertion of a mating plug.

10. The electrical connector as claimed in claim 9, wherein an upper part of the base is cut away, upper faces of the base and the mounting portion are flush with each other.

11. The electrical connector as claimed in claim 10, wherein an upper face of the mating tongue is higher than the upper face of the base.

12. The electrical connector as claimed in claim 11, wherein a lower face of the mounting portion is higher than a lower face of the base.

* * * * *